US009027503B2

(12) United States Patent
Sampson

(10) Patent No.: US 9,027,503 B2
(45) Date of Patent: May 12, 2015

(54) MULTI-PURPOSE COLLAR ATTACHMENT FOR FIRE HYDRANTS

(76) Inventor: Thomas Sampson, Plaistow, NH (US)

( * ) Notice: Subject to any disclaimer, the term of this patent is extended or adjusted under 35 U.S.C. 154(b) by 562 days.

(21) Appl. No.: 13/441,980

(22) Filed: Apr. 9, 2012

(65) Prior Publication Data

US 2012/0261002 A1 Oct. 18, 2012

Related U.S. Application Data

(60) Provisional application No. 61/474,302, filed on Apr. 12, 2011.

(51) Int. Cl.
*E03B 9/02* (2006.01)
*E03B 9/04* (2006.01)

(52) U.S. Cl.
CPC .... *E03B 9/04* (2013.01); *E03B 9/02* (2013.01)

(58) Field of Classification Search
CPC ..... E03B 9/02; E03B 9/04
USPC ..... 116/200, 202, 209, 280, 107, DIG. 1, 116/DIG. 43, 264, DIG. 11, DIG. 41; 340/331–332, 321, 69.1; 441/13, 16; 137/296; D10/109, 111
See application file for complete search history.

(56) References Cited

U.S. PATENT DOCUMENTS 2,175,565 A * 10/1939 Blackman et al. ..... 359/543
2,175,567 A * 10/1939 Blackman et al. ..... 359/543
2,424,269 A * 7/1947 Doody ..... 248/475.1
2,467,908 A * 4/1949 Rand ..... 248/475.1
4,398,556 A * 8/1983 Pereira et al. ..... 137/296
4,478,169 A 10/1984 Shrefler
4,602,654 A 7/1986 Stehling et al.
4,779,955 A * 10/1988 Schmanski ..... 359/552
4,827,969 A 5/1989 Lyasko
4,908,249 A * 3/1990 Lines ..... 428/36.9
5,029,550 A 7/1991 Hopper, Sr. et al.
5,056,454 A * 10/1991 Turner ..... 116/209
5,101,755 A * 4/1992 Barrett ..... 116/209
5,187,854 A * 2/1993 Bossi ..... 29/451
D336,262 S * 6/1993 O'Neal ..... D10/111
6,260,507 B1 7/2001 Simpson et al.
6,698,447 B1 * 3/2004 Cline ..... 137/272
6,758,160 B1 * 7/2004 Martin ..... 116/202
6,874,238 B2 * 4/2005 Cline ..... 33/1 CC
7,059,266 B1 6/2006 Burlando
7,099,781 B1 * 8/2006 Heidl et al. ..... 702/45
D571,439 S 6/2008 Wellner et al.
7,694,641 B2 * 4/2010 Lockhart ..... 116/209
8,657,021 B1 * 2/2014 Preta et al. ..... 169/61
8,819,899 B2 * 9/2014 Fietkiewicz ..... 24/274 R
2009/0128355 A1 * 5/2009 Urbin ..... 340/815.4
2014/0261730 A1 * 9/2014 Bost ..... 137/15.01
2014/0261731 A1 * 9/2014 Bost ..... 137/15.01

* cited by examiner

FOREIGN PATENT DOCUMENTS

CA 2351678 A1 * 12/2002

*Primary Examiner* — R. A. Smith
*Assistant Examiner* — Tania Courson
(74) *Attorney, Agent, or Firm* — Buckingham, Doolittle & Burroughs, LLC

(57) ABSTRACT

A multi-purpose reflective collar for attachment to a fire hydrant that increases the visibility of the hydrant to motorists and others, and that indicates the hydrant's flow rate, water source and pressure rating to firefighters and other first responders through the use of color coded reflective tape webs that can be removably attached to the collar. The multi-purpose reflective collar of the present invention is adjustable to accommodate fire hydrants of different shapes and sizes, and is useful in increasing safety and the efficiency of fire-fighting procedures.

19 Claims, 3 Drawing Sheets

| NFPA Flow Rating Color Coding System | |
|---|---|
| BLUE | 1500 GPM or more |
| GREEN | 1000-1499 GPM |
| ORANGE | 500-999 GPM |
| RED | Below 500 GPM |

FIG. 3

| NFPA Water Source Color Coding System | | |
|---|---|---|
| WHITE | Public System Hydrant | (EBMUD) |
| YELLOW | Private System Hydrant | Connected to public water main |
| RED | Special Operation Hydrant | Not used except for special procedures |
| VIOLET | Non Potable Supply | Effuent, pond or lake supply |

FIG. 4

| NFPA Pressure Rating Color Coding System | |
|---|---|
| GREEN | Over 120 p.s.i. |
| ORANGE | 50-120 p.s.i. |
| RED | Below 50 p.s.i. |

FIG. 5

MULTI-PURPOSE COLLAR ATTACHMENT FOR FIRE HYDRANTS

CROSS-REFERENCE

This application claims priority from Provisional Patent Application Ser. No. 61/474,302 filed on Apr. 12, 2011.

FIELD OF THE INVENTION

This invention relates to a multi-purpose reflective collar for attachment to a fire hydrant that increases the visibility of the hydrant to motorists and others, and that provides firefighters and other first responders with a wealth of information about the hydrant to which it is attached.

BACKGROUND

Fire hydrants are well known in the art and, in most communities, are located in spaced apart relationship in order to provide a source of water to fireman in fighting a fire within the proximity of the particular hydrant. Most fire hydrants are painted in bright colors to indicate their presence to traveling motorists, firefighters and other first responders. A fire hydrant that is not highly visible can pose a threat to travelling motorists, and may not be readily identifiable to firefighters. Moreover, the inability of a firefighter to locate a fire hydrant may delay the commencement of the fire fighting activities and thus endanger both life and property.

It is also common in the United States to mark fire hydrants according to a color code representing water flow capacity in accordance with standards developed by the National Fire Protection Association (NFPA). For example, light blue for Class AA indicates a flow rate of more than 1,500 gallons per minute (GPM); green for Class A indicates a flow rate of between 1,000-1,499 GPM; orange for Class B indicates a flow rate of between 500-999 GPM; and red for Class C indicates a flow rate between 0-499 GPM. Historically, although not common practice, color coding has been accomplished by simply painting the tops and nozzle caps of each fire hydrant housing with the appropriate color, preferably with reflective paint.

While this methodology of color coding fire hydrants has assisted firefighters in identifying the flow rate of a particular fire hydrant, it is not without its limitations. For example, weathering of paint applied to the fire hydrants causes a major maintenance problem for cities and municipalities. As paint, including reflective paint, weathers, the colors fade, making the fire hydrants more difficult to see, particularly in low light conditions. Further, as water supply capabilities and capacities change, it is common for a hydrant flow rating to change as well. Many cities have fire safety codes which require their hydrants to be periodically tested to make sure they are in working order and that they are properly flow rated. With conventional color painting schemes, this means that, as flow capacities change, portions of each affected fire hydrant should be repainted to reflect the hydrant's current flow rating. Due to the difficulty and expense involved in repainting, it is not uncommon for fire hydrants to be improperly color coded. Finally, even freshly painted fire hydrants are difficult to spot at night, particularly in poorly lighted neighborhoods. The ability to quickly spot and hook up to a fire hydrant is critical for firefighters in minimizing property damage and the potential for loss of life.

Other marking systems exist for identifying fire hydrants, such as the one described in U.S. Pat. No. 6,260,507 (Simpson). Simpson discloses attaching a collar with reflective tape to a fire hydrant to increase visibility of the fire hydrant, and to alert firefighters to the particular flow rating of the hydrant. However, the Simpson device is a relatively bulky collar that appears expensive to manufacture and cumbersome to use. Moreover, the reflective tape used in Simpson only discloses the flow rating of the hydrant, and not any additional information about the hydrant. For example, it is also desirable for a firefighter to know other information about the particular fire hydrant before utilizing the same including, without limitation, the source of the water for the hydrant and the pressure rating of the hydrant. Many firefighters spend precious time during an emergency trying to determine this type of information, which leads to unnecessary delay in fighting the fire and can result in the unnecessary loss of life and/or property.

Consequently, there exists in the art a long-felt need for an improved multi-purpose reflective collar for attachment to a fire hydrant that not only increases the visibility of the hydrant to motorists and others, but that also provides firefighters and other first responders with a wealth of information about the hydrant to which it is attached. More specifically, there is a long-felt need for an improved multi-purpose reflective collar for attachment to a fire hydrant that advises firefighters and other first responders of at least the hydrant's flow rate, water source and pressure rating, and that is adjustable to accommodate fire hydrants of different shapes and sizes. Finally, there is a long-felt need for a device that accomplishes all of the forgoing objectives and that is relatively inexpensive to manufacture, and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an improved multi-purpose collar for attachment to a fire hydrant comprised of a collar structure, which is adjustable in interior diameter and which further comprises a display area; a first web removably positionable in said display area for indicating a flow rating for the fire hydrant; a second web removably positionable in said display area for indicating a water source for the fire hydrant; a third web removably positionable in said display area for indicating a pressure rating for the fire hydrant; and a securing means for attaching said collar to the fire hydrant.

The improved multi-purpose collar of the present invention increases hydrant visibility which can assist in reducing or preventing motor vehicle accidents, while also decreasing the amount of time that a firefighter will have to spend searching for the fire hydrant and its associated flow rating, water source and pressure rating. Consequently, the improved multi-purpose collar of the present invention increases safety and the efficiency of firefighting procedures.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

FIG. 3 illustrates the current NFPA flow rating color coding system.

FIG. 4 illustrates the current NFPA water source color coding system.

FIG. 5 illustrates a the current NFPA pressure rating color coding system.

DETAILED DESCRIPTION

Figure 1:
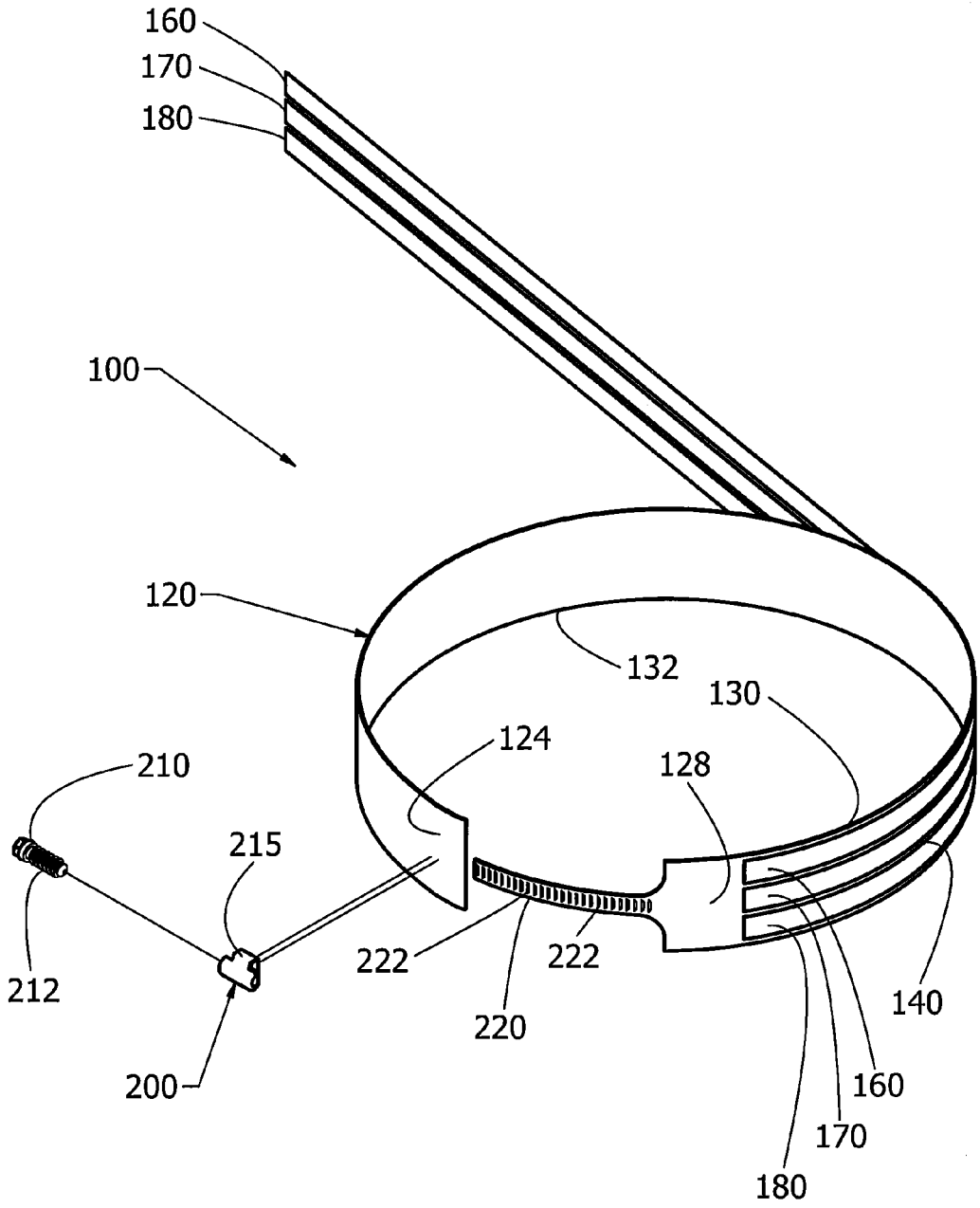
FIG. 1 illustrates an exploded view of the various components of one embodiment of the improved collar of the present invention.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

The present invention discloses an improved multi-purpose reflective collar for attachment to an existing fire hydrant that both increases the visibility of the hydrant, and informs firefighters of the flow rating, water source and pressure rating of the hydrant. The collar is relatively inexpensive to manufacture, easy to use, and adjustable to accommodate fire hydrants of various shapes and sizes. Referring initially to the drawings, FIG. 1 illustrates an exploded view of the various components of a preferred embodiment of the improved collar 100 of the present invention, which comprises a collar structure 120, a first reflective tape web 160 removably attached to said collar structure 120, a second reflective tape web 170 removably attached to said collar structure 120, a third reflective tape web 180 removably attached to said collar structure 120, and an adjustable securing means 200 for attaching said collar 100 to a wide variety of fire hydrants 300 of different shapes and sizes.

More specifically, collar structure 120 is preferably an elongated, generally rectangular strip or band of reflective stainless steel material further comprised of a first end 124, a second end 128, a top 130, a bottom 132, and a display area 140 positioned between said first end 124 and said second end 128. Nonetheless, it is also contemplated that collar structure 120 could be comprised of other shapes and/or other durable materials such as plastic, metal, aluminum, and the like without affecting the overall concept of the invention. The length of collar structure 120 is preferably between 6 and 50 inches, measured from first end 124 to second end 128 to accommodate most sizes of fire hydrants 300 as described more fully below. The width of collar structure 120 is preferably between 1 and 3 inches, measured from the top 130 to the bottom 132, to accommodate each of the first, second and third tape webs 160, 170 and 180 as described more fully below, and the thickness of collar structure 120 is preferably between 0.005 and 0.25 of an inch. Notwithstanding, it is contemplated that collar structures 120 with other lengths, widths and thicknesses could also be used, and the forgoing preferred dimension ranges should not be construed as limitations of the present invention.

Figure 2:
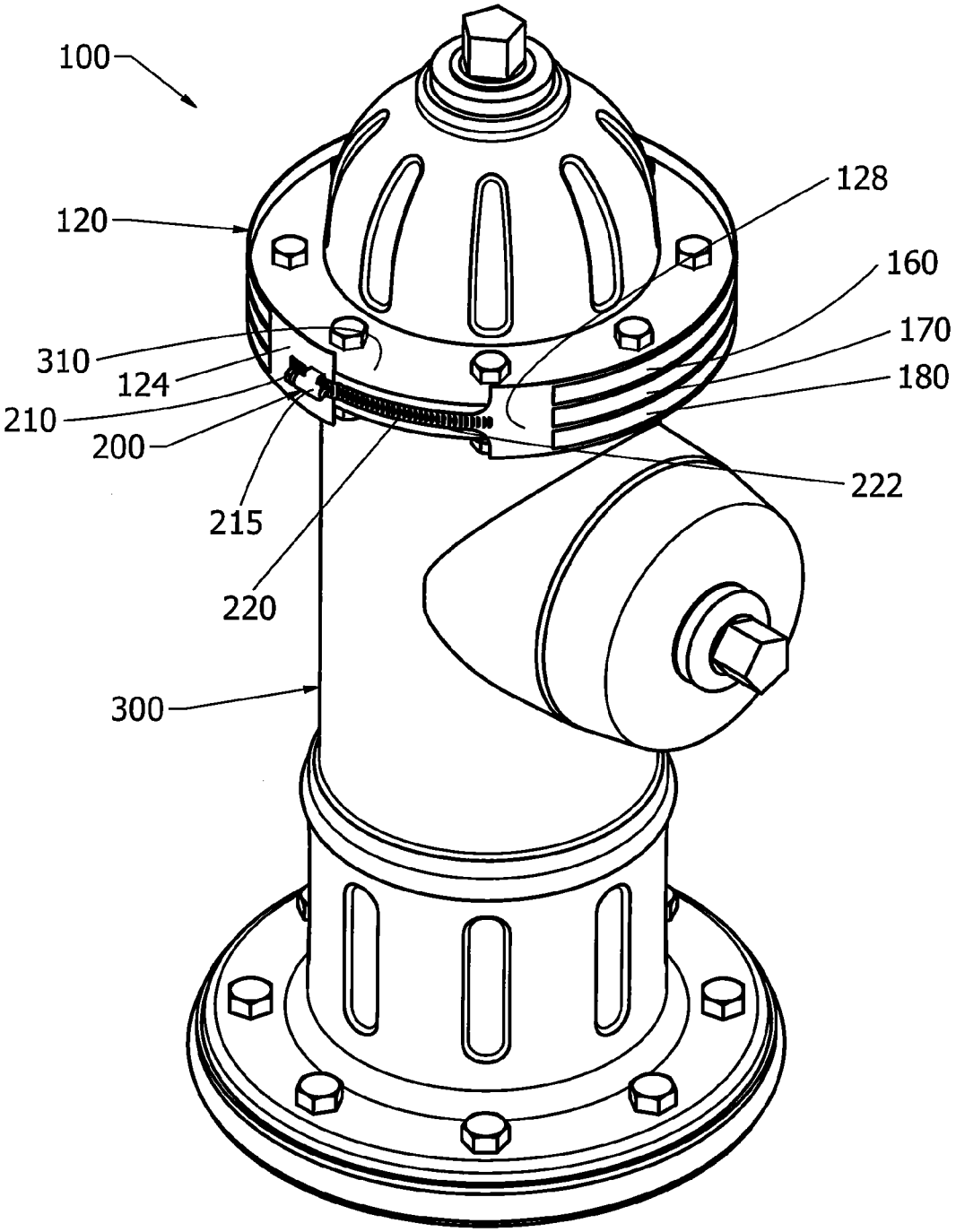
FIG. 2 illustrates a perspective view of the improved collar of the present invention, assembled and installed on a fire hydrant.

Display area 140 refers to the portion of collar structure 120 that is between the first end 124, second end 128, top 130 and bottom 132, and faces outward from the hydrant 300 upon which collar 100 is installed, as best illustrated in FIG. 2. Display area 140 is useful for mounting first, second and third tape webs 160, 170 and 180, as described more fully below. As previously mentioned, collar structure 120, including display area 140, is preferably comprised of a reflective material, such as stainless steel, to increase the visibility of collar 100 and the hydrant 300 to which it is attached. It will be appreciated by those of ordinary skill in the art that increasing the visibility of hydrant 300 assists in reducing or preventing motor vehicle accidents, while also decreasing the amount of time that a firefighter (not shown) will have to spend searching for the fire hydrant.

Securing means 200 is used to removably attach collar structure 120 to a hydrant 300, and is preferably comprised of an adjustable band or clamp, such as a worm gear clamp, band clamp, zip-tie, cable, band or the like. FIGS. 1 and 2 depict a securing means 200 that is a worm gear clamp comprised of a screw 210 with threads 212 located thereon, a screw housing 215 and a band portion 220 with a plurality of openings 222 located thereon, all of which are well known in the art and readily available in most hardware or automotive parts stores. As is well known in the art, screw 210 is permitted to rotate within screw housing 215 in both the clockwise and counterclockwise directions, the purpose of which will be described more fully below.

In a preferred embodiment of the present invention, screw housing 215 is fixedly attached to either first end 124 or second end 128 of collar structure 120, and band portion 220 is fixedly attached to the opposite end 124 or 128 of collar structure 120, by any means commonly known in the art such as spot welding, rivet, solder, glue or weld. More specifically, band portion 220 extends beyond the first or second end 124, 128 of collar structure 120 to which it is attached for engagement with screw 210 and screw housing 215, which are attached to the opposite end of collar structure 120. Consequently, when first end 124 and second end 128 are brought together so that the end of band portion 220 extending beyond the end of collar structure 120 can be inserted into screw housing 215 for engagement with screw 210 as described more fully below, a generally circular shape is achieved by collar structure 120.

Each of first, second and third tape webs 160, 170 and 180 is preferably comprised of reflective adhesive tape, which is well known in the art and readily available from most hardware, department of mail order stores. Each of first, second and third tape webs 160, 170 and 180 is color coded to correspond with the NFPA color coding systems relative to flow rating, water source, and pressure rating, respectively. By way of example, a light blue first tape web 160 would be used to indicate to a firefighter that a particular hydrant 300 has a flow rate of more than 1,500 GPM. Similarly a violet or purple second tape web 170 would be used to indicate to a firefighter that a particular hydrant 300 has a potable water source, and a green third tape web 180 would be used to indicate to a firefighter that a particular hydrant 300 has a pressure rating of over 120 pounds per square inch. FIG. 3 illustrates the current NFPA flow rating color coding system which is intended to be used in conjunction with said first tape web 160, and FIG. 4 illustrates the current NFPA water source color coding system, which is intended to be used in conjunction with said second tape web 170. Finally, FIG. 5 illustrates a the current NFPA pressure rating color coding system, which is intended to be used in conjunction with said third tape web 180. Notwithstanding, it is also contemplated that other types of tape, stickers, indicia, etc. could also be attached to display area 140 to indicate pertinent information to firefighters (not shown) about a particular hydrant 300.

In an exemplary embodiment of the present invention, each of first, second and third tape webs 160, 170 and 180 is removably attached to display area 140 of collar structure 120 by using the adhesive backing on webs 160,170, 180. Nonetheless, other methods of attaching webs 160, 170, 180 to display area 140 are also contemplated including, without limitation, glue, tape, adhesive, and the like.

Each of first, second and third tape webs 160, 170 and 180 is preferably slightly shorter in length than the length of collar structure 120 so that the tape webs are visible from any vantage point around the hydrant 300. Similarly, the sum of the widths of each of first, second and third tape webs 160, 170 and 180 is preferably less than or equal to the overall width of display area 140 so that all three tape webs 160, 170, 180 can be attached to display area 140 in stacked fashion, as is shown in FIG. 2. More specifically, and for consistency purposes, it is contemplated that first tape web 160 would be attached to display area 140 near the top 130 of collar structure, second tape web 170 would be attached to display area 140 below first tape web 160, and third tape web 180 would be attached to display area 140 below second tape web 170, as depicted in FIG. 2. By maintaining a consistent marking convention, firefighters across the country will be able to quickly and accurately identify the flow rating, water source, and pressure rating of any hydrant 300 with a collar 100 installed thereon. Notwithstanding, it is contemplated that other marking conventions could be employed without affecting the overall concept of the present invention. For example, the upper most tape web, defined as the tape web positioned closest to the top 130, could be used to indicate water source or pressure rating, as opposed to flow rating and so on and so forth for the second and third tape webs.

Having now described the preferred embodiment of collar 100, its use and usefulness will now be described. A user (not shown) desiring to make a hydrant 300 more visible and/or display information about the hydrant's characteristics, such as the flow rating, water source and/or pressure rating, can easily and removably attach collar 100 to hydrant 300. More specifically, collar 100 may be attached to an upper flange 310 of a hydrant 300 by wrapping the collar structure 120 around the flange 310, as illustrated in FIG. 2, and inserting the end of band portion 220 extending beyond the end of collar structure 120 into screw housing 215 for engagement with screw 210. In order to remove the slack from collar structure 120 and tighten the collar 100 on upper flange 310, the user simply turns screw 210 in a clockwise direction thereby causing threads 212 to engage openings 222 in band portion 220, which reduces the inside diameter of the collar 100 against upper flange 310 and secures collar 100 to hydrant 300.

Once collar 100 is installed on hydrant 300, or perhaps before collar 100 is installed on hydrant 300, a first tape web 160 whose color or other indicia corresponds to the flow rating of the hydrant 300 can be attached to display area 140 in the manner described above. Similarly, a second tape web 170 can be attached to display area 140 to indicate, via color coding or some other indicia, the water source of hydrant 300, and a third tape web 180 can be attached to display area 140 to indicate the pressure rating of the hydrant 300 in a similar fashion. As previously mentioned, for consistency purposes, it is contemplated that first tape web 160 would be attached to display area 140 near the top 130 of collar structure, second tape web 170 would be attached to display area 140 below first tape web 160, and third tape web 180 would be attached to display area 140 below second tape web 170, as depicted in FIG. 2. By maintaining a consistent marking convention, firefighters across the country will be able to quickly and accurately identify the flow rating, water source, and pressure rating of any hydrant 300 with a collar 100 installed thereon.

In order to remove collar 100 from an existing hydrant 300, the user would simply turn screw 210 in a counter-clockwise direction thereby causing threads 212 to disengage openings 222 in band portion 220 and increase the inside diameter of the collar 100 against hydrant 300, or disconnect said first end 124 from second end 128.

It is also contemplated that collar 100 can be installed on locations on the fire hydrant 300 other than upper flange 310. Further, because the inside diameter of the collar is adjustable through the use of securing means 200, it should be appreciated by one of ordinary skill in the art that collar 100 can be used on a wide variety of fire hydrants 300 of different shapes and sizes.

It should also be appreciated that as the characteristics of the particular hydrant 300 change over time, a user (not shown) can simply attach a different colored web 160, 170 180 over the existing web to indicate the new characteristic, without having to replace the collar device 100. For example, if the flow rating of hydrant 300 drops from 1,600 GPM to 1,400 GPM, a user can replace or overlay the light blue first tape web 160 that corresponds with a flow rate of more than 1,500 GPM with a green first tape web 160 that corresponds with a flow rate of between 1,000-1,499 GPM, all without having to remove or replace collar 100. Similar updating can be made to second tape web 170 and/or third tape web 180, thereby enabling municipalities and fire departments around the country to quickly and inexpensively update their hydrants 300 with the latest information. This particular feature of the present invention is also important if NFPA elects to revise its color coding system in the future, at which time the collar 100 of the present invention can easily be adapted to correspond to the revised system.

Additionally, other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A collar comprising:

a collar structure which is adjustable in interior diameter and which further comprises a display area, wherein said collar structure is attached to a fire hydrant by a securing means;

a first tape web removably positionable in said display area, wherein said first tape web displays a flow rating for the fire hydrant;

a second tape web removably positionable in said display area, wherein said second tape web displays a water source for the fire hydrant; and a third tape web removably positionable in said display area, wherein said third tape web displays a pressure rating for the fire hydrant.

2. The collar of claim 1 wherein said securing means is a worm gear clamp.

3. The collar of claim 1 wherein each of said first, second and third tape webs is comprised of a reflective material.

4. The collar of claim 1 wherein said first tape web is color coded to indicate the flow rating of the fire hydrant in accordance with a flow rating color coding system.

5. The collar of claim 1 wherein said second tape web is color coded to indicate the water source for the fire hydrant in accordance with a water source color coding system.

6. The collar of claim 1 wherein said third tape web is color coded to indicate the pressure rating for the fire hydrant in accordance with a pressure rating color coding system.

7. A collar for attachment to a fire hydrant comprising:

an adjustable collar structure which further comprises a display area;

a first reflective tape web removably positionable in said display area, wherein said first reflective tape web displays a flow rating for the fire hydrant;

a second reflective tape web removably positionable in said display area, wherein said second reflective tape web displays a water source rating for the fire hydrant; and a securing means for attaching said collar to the fire hydrant.

8. The collar of claim 7 wherein said securing means is a worm gear clamp.

9. The collar of claim 7 wherein said securing means is a band clamp.

10. The collar of claim 7 wherein said first reflective tape web is positioned in said display area above the second reflective tape web.

11. The collar of claim 7 wherein said collar further comprises a third reflective tape web removably positionable in said display area for indicating a pressure rating for the fire hydrant.

12. The collar of claim 11 wherein said second reflective tape web is positioned in said display area above the third reflective tape web.

13. The collar of claim 11 wherein said first reflective tape web is positioned in said display area above the third reflective tape web.

14. The collar of claim 11 wherein each of the first reflective tape web, the second reflective tape web and the third reflective tape web are color coded.

15. A collar comprising:

a collar structure which is adjustable in interior diameter and which further comprises a display area, wherein said collar structure is attached to a fire hydrant by a band clamp;

a first tape web removably positionable in said display area, wherein said first tape web displays a flow rate for the fire hydrant;

a second tape web removably positionable in said display area, wherein said second tape web displays a water source for the fire hydrant, and further wherein said second tape web is located beneath said first tape web; and a third tape web removably positionable in said display area, wherein said third tape web displays a pressure rating for the fire hydrant, and further wherein said third tape web is located beneath said second tape reflective web.

16. The collar of claim 15 wherein said securing means is a worm gear clamp.

17. The collar of claim 15 wherein each of said first, second and third tape webs is comprised of a reflective material.

18. The collar of claim 15 wherein said first tape web is color coded to indicate the flow rating of the fire hydrant in accordance with a flow rating color coding system, said second tape web is color coded to indicate the water source for the fire hydrant in accordance with a water source color coding system, and said third tape web is color coded to indicate the pressure rating for the fire hydrant in accordance with a pressure rating color coding system.

19. The collar of claim 18 wherein each of the flow rating color coding system, the water source color coding system, and the pressure rating color coding system are maintained by the National Fire Protection Association.

* * * * *